US005396698A

United States Patent [19]

Orthmann et al.

[11] Patent Number: 5,396,698

[45] Date of Patent: Mar. 14, 1995

[54] MANUFACTURE OF A FLEXIBLE ANTENNA

[75] Inventors: Kurt Orthmann, Munich; Heinrich Brenninger, Kranzberg, both of Germany

[73] Assignee: Texas Instruments Deutschland GmbH, Freising, Germany

[21] Appl. No.: 239,261

[22] Filed: May 6, 1994

Related U.S. Application Data

[63] Continuation of Ser. No. 7,703, Jan. 22, 1993, abandoned.

[51] Int. Cl.[6] ..... H01P 11/00

[52] U.S. Cl. ..... 29/600; 336/83

[58] Field of Search ..... 29/600; 336/83

[56] References Cited

U.S. PATENT DOCUMENTS

| | | | |
|---|---|---|---|
| 4,400,674 | 8/1983 | Suda et al. . | |
| 4,814,782 | 3/1989 | Chai . | |
| 4,862,184 | 8/1989 | Ploussios | 29/600 X |
| 5,017,940 | 5/1991 | Rigollet | 29/600 X |

FOREIGN PATENT DOCUMENTS

| | | |
|---|---|---|
| 0348636 | 5/1989 | Germany . |
| 54-154245 | 5/1979 | Japan . |

OTHER PUBLICATIONS

Ferrite Antenna, vol. 4, No. 14 (E-169) 31 Jan. 1980 and JP-A-54 154 245 (Matsushita) 12 May 1979.

Loop Antenna System, vol. 10, No. 184 (E-415) (2240) 27 Jun. 1986 and JP-A-61 030 803 (Matsushita) 13 Feb. 1986.

*Primary Examiner*—Carl J. Arbes

*Attorney, Agent, or Firm*—Rebecca A. Mapstone; James C. Kesterson; Richard L. Donaldson

[57] ABSTRACT

An antenna comprising a sheet-like, flexible multipart magnetic core (16) manufactured of ferromagnetic material is provided with an antenna winding which is made up of a plurality of turns and surrounds the magnet core (16). The turns of the antenna winding are formed by printed wiring (12*a* and 12*b*) arranged on a flexible film (10*a* and 10*b*) surrounding the magnet core (16).

9 Claims, 10 Drawing Sheets

MANUFACTURE OF A FLEXIBLE ANTENNA

This application is a continuation of application Ser. No. 08/007,703, filed Jan. 22, 1993, now abandoned.

FIELD OF THE INVENTION

The invention relates to an HF antenna comprising a sheet-like, flexible multipart magnetic core, manufactured of ferromagnetic material and antenna winding, which is made up of a plurality of turns and surrounds the magnetic core.

The invention, furthermore, relates to a method for the production of such an HF antenna and to a transponder system equipped with such an antenna.

BACKGROUND OF THE INVENTION

One known HF flexible antenna is utilized in a wrist watch which has the particular feature that it is controlled by radio signals, which are synchronized by a precision atomic master clock. In order to provide for the flexibility of the HF antennas the magnetic core is built up of a plurality of thin flexible layers of amorphous metallic glass. The antenna winding consists of thin copper wire, which is wrapped around the magnetic core in a plurality of layers. At the winding itself the magnetic core is not flexible so that it is not possible to greatly increase the number of turns of the coil. In fact, if the winding has a great length in the direction of the magnetic core axis, the magnetic core will be stiff in a substantial part thereof so that it can not be bent without the risk of damage. Furthermore, the copper wire winding wrapped around the magnetic core is responsible for a substantial increase in the thickness of the core adjacent to said winding, so that such an antenna may not be utilized for applications where a particularly thin configuration is necessary.

SUMMARY OF THE INVENTION

One object of the present invention is to provide an HF antenna, which is flexible along the full length of its magnetic core, and together with the winding surrounding the magnetic core, has a very thin or sheet-like form.

In accordance with the invention, this object is attained by having a winding whose turns are in the form of printed wiring on a flexible film surrounding the magnetic core.

In the HF antenna, in accordance with the invention, not only is the magnetic core flexible but also the winding surrounding it so that no part of the core is stiffened. Owing to the form of turns constituted by printed wiring on a flexible film, there is no impairment at all of the flexibility of the magnetic core by the winding on it, since the film with the printed wiring applied to it itself constitutes a flexible structure.

Advantageous methods for the production of the HF antenna in accordance with the invention are recited in the following specification.

The HF antenna in accordance with the invention can be employed advantageously in a transponder system with a passive answering device which, as a reaction to an interrogating pulse transmitted by an interrogating device and received by an HF antenna, transmits, via the antenna, an answer signal able to be received by the interrogating device and the containing data stored in the answering device.

BRIEF DESCRIPTION OF THE DRAWINGS

The invention will now be described with reference to the figures by way of example.

DETAILED DESCRIPTION OF THE PREFERRED EMBODIMENTS

Figure 1A:
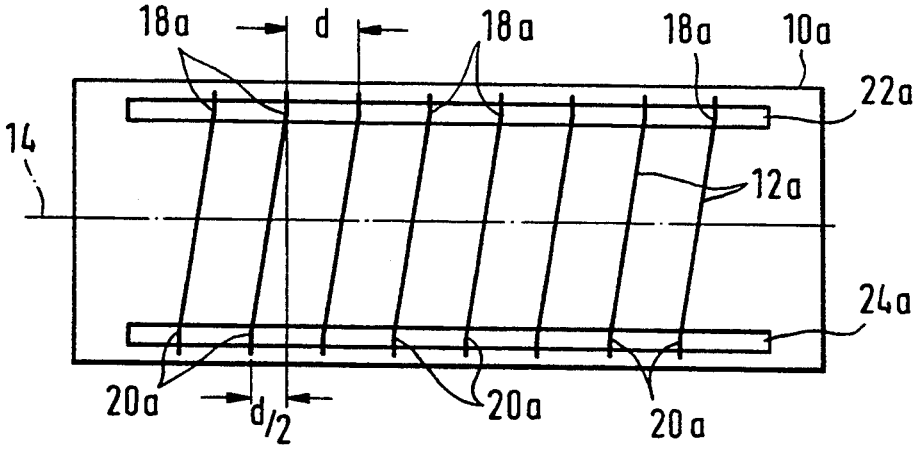
FIGS. 1*a* and 1*b* show two identical film members with printed wiring applied thereto in order to form a winding.
Figure 1B:
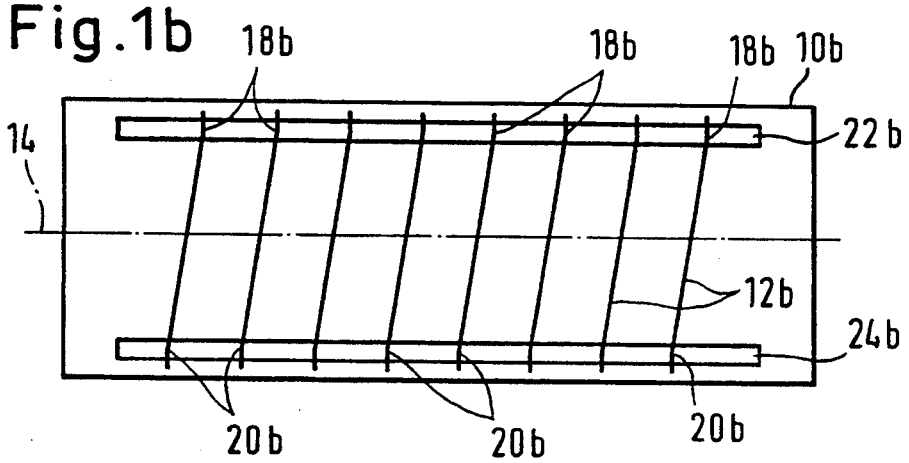
Figure 2:
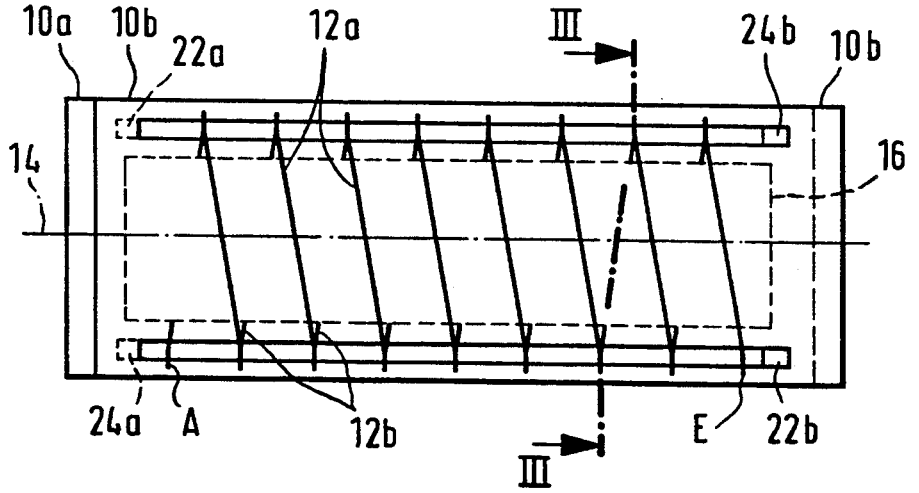
FIG. 2 is a diagrammatic view of an HF antenna formed using the film members illustrated in FIGS. 1*a* and 1*b* with the inserted magnetic core in accordance with the invention.

A first embodiment of the HF antenna to be described herein comprises a winding which is composed of two identical film parts 10*a* and 10*b* as illustrated in FIGS. 1*a* and 1*b*. On one surface of the film parts 10*a* and 10*b*, printed wiring 12*a* and 12*b* is applied. The production of the said printed wiring 12*a* and 12*b* on the film members 10*a* and 10*b* may take place using state of the art printed circuit board manufacturing methods. The printed wiring 12*a* and 12*b* is arranged at such an angle to the longitudinal axis 14 of a magnetic core 16, which is to be employed together with the film parts 10*a* and 10*b* as shown in FIG. 2, such that the end points 18*a* and 18*b* on the one edge of the film members 10*a* and 10*b* from the starting points 20*a* and 20*b*, placed on the other edge of the film parts 10*a* and 10*b*, of the printed wiring 12*a* and 12*b*, are offset by half the distance between the sections of printed wiring 12*a* and 12*b* as measured along the longitudinal axis 14 of the magnetic core 16. In FIG. 1*a*, the distance of the end points 18*a* is indicated as d and furthermore the offset by d/2 will be seen.

In this embodiment, the magnetic core 16 shown in FIG. 2 consists of thin flexible layers of amorphous metallic glass as will be explained below.

The printed wiring 12*a* on the film member 10*a* forms half a winding layer of the complete winding layer surrounding magnetic core 16 in the finished HF antenna. The second half of the winding layer is constituted by the printed wiring 12*b* on the film member 10*b*.

As shown in FIG. 1, the film parts 10*a* and 10*b* have respective elongated windows 22*a*, 22*b*, and respectively, 24*a* and 24*b* formed in them adjacent to the starting points 20*a* and 20*b* and the end points 18 and 18*b*, such windows being spanned by the printed wiring 12*a* and 12*b*. In the first illustrated working embodiment, these windows are necessary in order to connect the printed wiring sections together and hence to complete the winding layer surrounding the magnetic core 16. In the following account of the structure of the HF antenna, it is assumed that the printed wiring 12*a* and 12*b* in the FIGS. 1*a* and 1*b* is applied to the surface of the film parts 10*a* and 10*b* which is turned away from the reader. For assembly of the HF antenna the magnetic core 16 is so positioned on the film part 10*a* that it assumes the position illustrated in FIG. 2. This means that the printed wiring 12*a* is on the surface of the film part 10*a* which is facing away from the magnetic core 16. After this, the film part 10*b* is so positioned on the magnetic core 16 that the printed wiring 12*b* is on the surface, which is facing away from the magnetic core 16, of the film part 10*b*; this arrangement is to be seen in FIG. 2. In this arrangement the windows 22*b* and 24*a* and furthermore 22*a* and 24*b* are arranged over each other, and the parts of the printed wiring respectively spanning these windows are directly opposite to each other without there being any film material between them. The starting and end points of the directly opposite printed wiring may be connected together by various different methods so that after connection a complete winding layer extends around the magnetic core 16, which runs from the starting point A as far as the end point E. It is to be noted that the distances between the individual windings are of course substantially smaller in practice than in the figures so that a large number to turns may be wound around the magnetic core 16.

Figure 3:
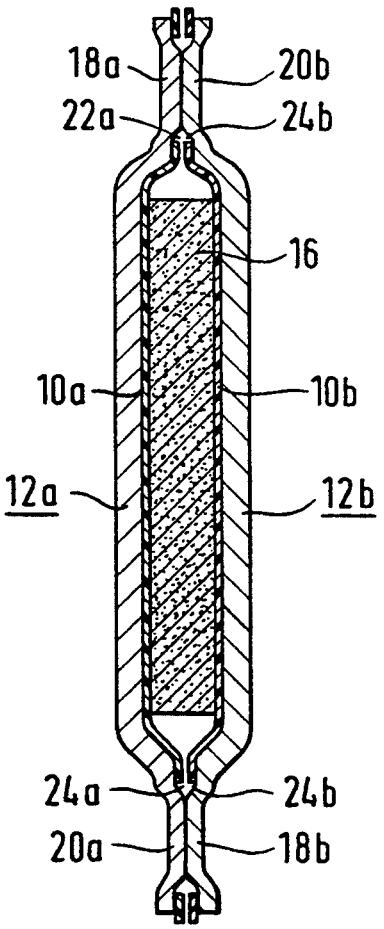
FIG. 3 shows a cross-section on a larger scale taken on the line III—III of FIG. 2.

In the illustrated embodiment in cross-section in FIG. 3 taken along the line III—III in FIG. 2, it will be seen how the two film parts 10*a* and 10*b* with the printed wiring 12*a* and 12*b* applied thereto are wrapped around the magnetic core 16. In the parts of the mutually associated windows 22*a*, 24*b* and 22*b*, 24*a* the printed wiring 12*a* and 12*b* is electrically connected together at its directly opposite start and end points 20*b* and 20*a* as well 18*a* and 18*b*. This connection may be either produced by soldering or by welding.

A preferred embodiment of the HF antenna will now be described with reference to FIGS. 4 through 6.

Figure 4:
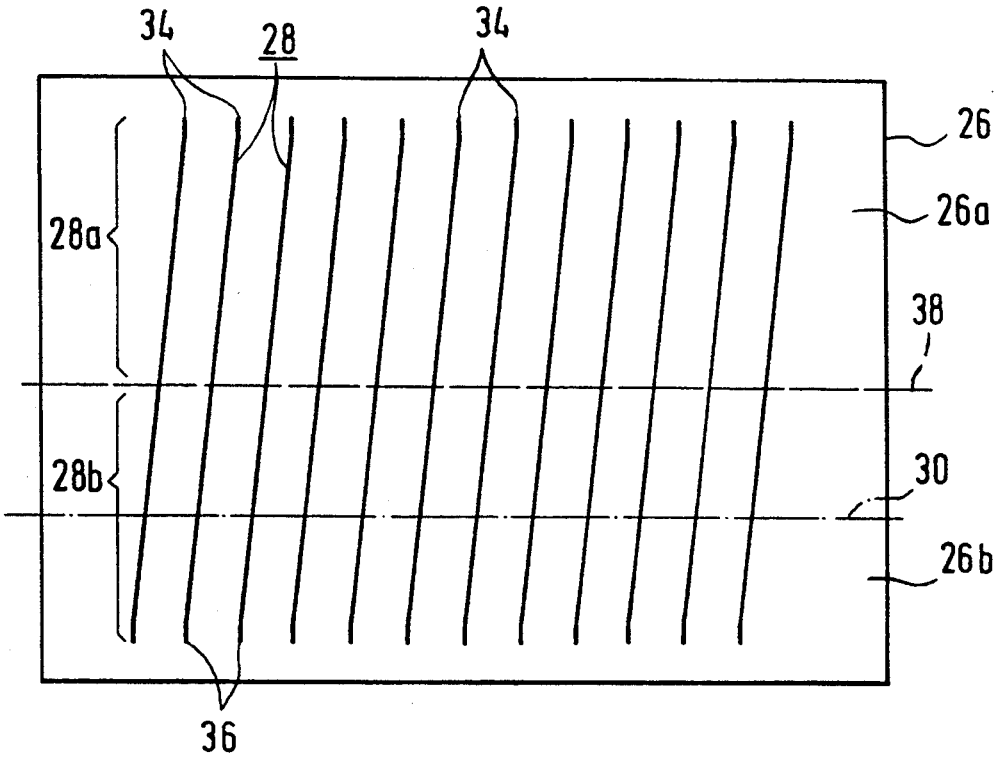
FIG. 4 shows a film with applied printed wiring in order to form one complete layer of winding.
Figure 5:
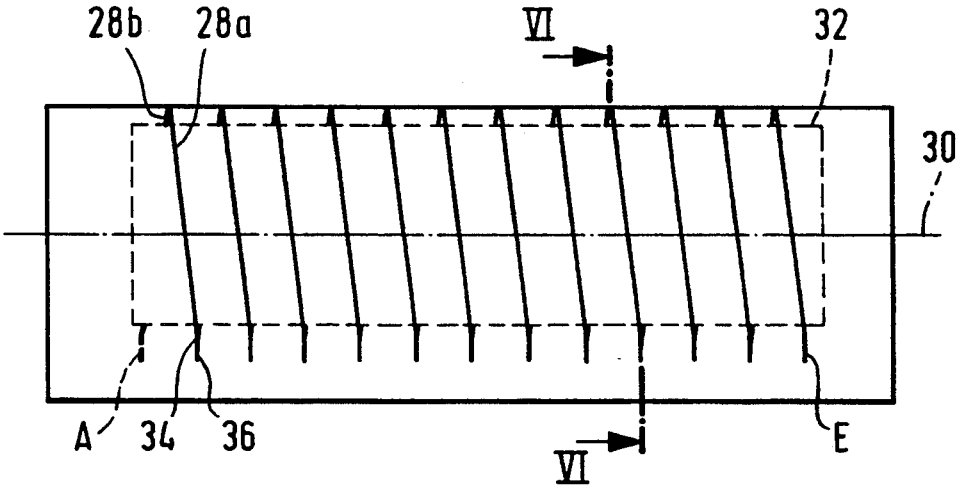
FIG. 5 shows an HF antenna formed using the film in accordance with FIG. 4 with an inserted magnetic core in accordance with the invention.

FIG. 4 shows a film 26, which consists of two integrally joined film parts 26*a* and 26*b*. The surface turned away from the reader of the film 26 bears printed wiring 28, which constitutes a complete winding layer. The printed wiring 28 consisting of connected printed wiring sections 28*a* and 28*b*, which in this case run at such an angle to the longitudinal axis 20 of the magnetic core 32 illustrated in FIG. 5 that the end points 34 of the printed wiring sections 28*a* assume a position exactly over the starting point 36 of the printed wiring sections 28*b*, when the film 26 is bent along the line 38 through 180°. This happens when the end points 34 are offset by the full spacing (as measured in the direction of the longitudinal axis 30 of the magnetic core 32) between the printed wiring 28 (as measured in the direction of the longitudinal axis 30 of the magnetic core 32) in relation to the starting points 36. In order to complete the HF antenna, the magnetic core 32 is so positioned on the film 26 that its longitudinal axis 30 assumes the position shown in broken lines in FIG. 4, whereafter the film 26 is bent around the line 38 through 180°, so that it surrounds the magnetic core 32 like a loop. Owing to the oblique setting of the printed wiring the end points 34 are exactly over the starting points 36 so that the same are able to be electrically connected with each other. The printed wiring 28 then constitutes a complete winding layer surrounding the magnetic core 32, such layer extending from the starting point A to the end point E.

As shown in FIG. 4, adjacent to the starting point 36, adjacent to starting points 36 and adjacent to the end points 34 of the printed wiring 28, no windows are formed. Owing to the selection of a special material for the film 26, it is nevertheless possible to produce electrically conducting connections between the printed wiring. If a polyester is used as a material, it is possible for the printed wiring to be welded together adjacent to the starting and end points by pressing from both sides with hot dies at the points to be connected. Owing to the transmitted heat, the film material becomes soft and runs out to the side until there is direct contact between the printed wiring material. The printed wiring material may then be welded in a conventional manner. As shown in FIG. 6 in the section taken on the line VI—VI of FIG. 5, the indicated type of connection of the printed wiring will be clearly seen at the start and end points. Furthermore, independent of the use of other materials for the film, it is possible to employ other methods for the connection of the start and end points of the printed wiring.

Figure 7:
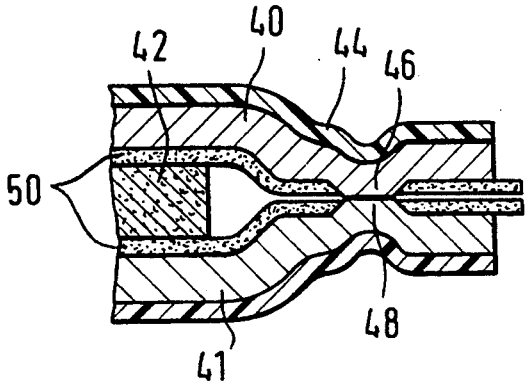
FIGS. 7 and 8 show cross-sections on a larger scale of the connection parts of the printed wiring in different possible designs.

As shown in FIG. 7, which is a cross-sectional view of the connection area, a specific method of connection may be utilized if the film material is polyamide. A particular feature of the HF antenna made using this film in this connection method is that the printed wiring 40 is positioned on the surface, that is facing the magnetic core 42, of the polyamide film 44. Alternatively, if the printed wiring 40 is positioned on the side facing away from the reader, that is not touching the magnetic core 42, of the polyamide film 44, windows, as disclosed in FIGS. 1 and 2, would be required. Using the former foil configuration, in order to connect the printed wiring 40 adjacent to start and end points, projections 46 and 48 are produced at these positions when the printed wiring is produced. For the insulation of the printed wiring from the magnetic core 42, an adhesive layer 50 is provided on the printed wiring side of the film 44, which in addition to the insulating effect also ensures adhesion of the film to the magnetic core 42. The adhesive layer 50 originally also extended over the projections 46 and 48 of the printed wiring, but however, for the production of the connections at the start and end points, pressure is applied in these zones on the film so that the projections 46 and 48 pierce the adhesive layer 50 and come into contact with each other. Owing to the use of the adhesive layer 50, the electrically conducting connection produced persists even when no pressure is applied to the connecting zones.

Figure 8:
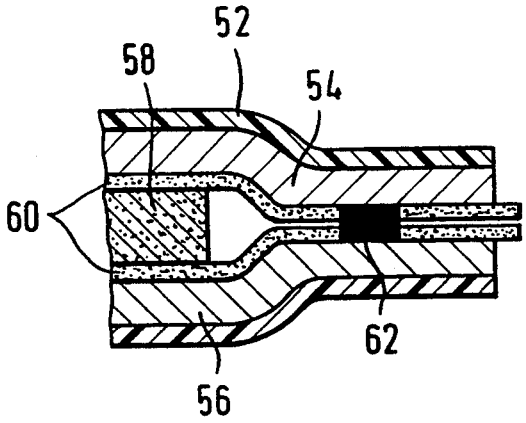

Like FIG. 7, FIG. 8 shows, on a larger scale, a cross-section of the connecting region of the printed wiring 54 and 56 of film 52, in order to indicate another way of producing the electrical connection for the printed wiring 54 and 56. The film 52 consists of polyamide as in the working embodiment of FIG. 7, and the printed wiring 54 and 56 is positioned on the surface that faces the magnetic core 58, of the film 52. In order to provide electrical insulation between the printed wiring 54 and 56 and the magnetic core 58, an adhesive layer 60 is utilized. At the sites of the eventual connections to be produced, openings are formed in the adhesive layer 60 and in the openings the exposed printed wiring material is tinned. In order to produce the connection, heat and pressure are applied through the polyamide film to the connecting zone so that a soldered joint 62 is produced between the sections 54 and 56 of the printed wiring.

Figure 9:
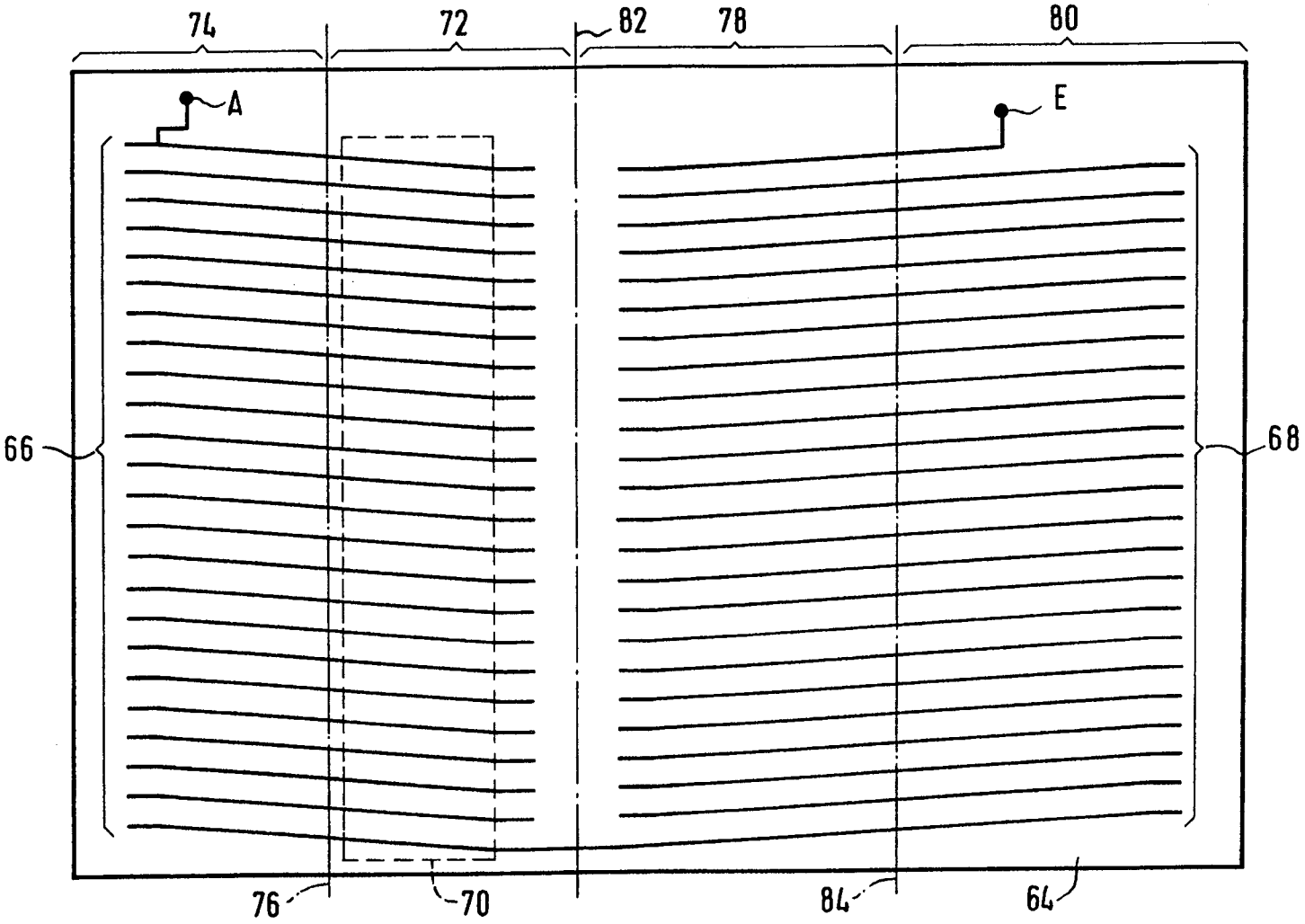
FIG. 9 shows a film with printed wiring in order to form a two-layered winding.

By having recourse to the system described above for the production of a single-layer winding, it is possible, while maintaining desired flexibility, to arrive at a multi-layer winding on the magnetic core. As shown in FIG. 9, a film 64 bears a printed wiring section 66 in order to constitute a first winding layer and printed wiring section 68 to form a second one. In order to produce a twin-layer HF antenna, the magnetic core 70 is so positioned on the section 72 of the film 64 as is illustrated in broken lines in FIG. 9. The film section 74 is then folded along the line 76 through 180° onto the magnetic core 70. The mutually opposite start and end points of the printed wiring 66 are electrically connected with each other using one of the above described methods. After this, the film 64 with the film sections 78 and 80 is folded to the left (in terms of FIG. 9) through 180° along the line 82 so that the film section 78 takes up a position over the film section 72 and the magnetic core 70. In the next step the film section 80 is so folded along the line 84 through 180° that it is underneath the film section 74 and the magnetic core 70. The start and end points, which in this condition are superposed, of the printed wiring 68 are electrically connected with each other using one of the above methods. As shown in FIG. 9, the lowermost section of the printed wiring 66 is connected with the lowermost section of the printed wiring 68 directly on the film so that after the described folding or bending and connecting operations a continuous winding extends through the first winding layer with the printed wiring 66 and the second winding layer extends with the printed wiring 68 from the start point A to the end point E.

Figure 10:
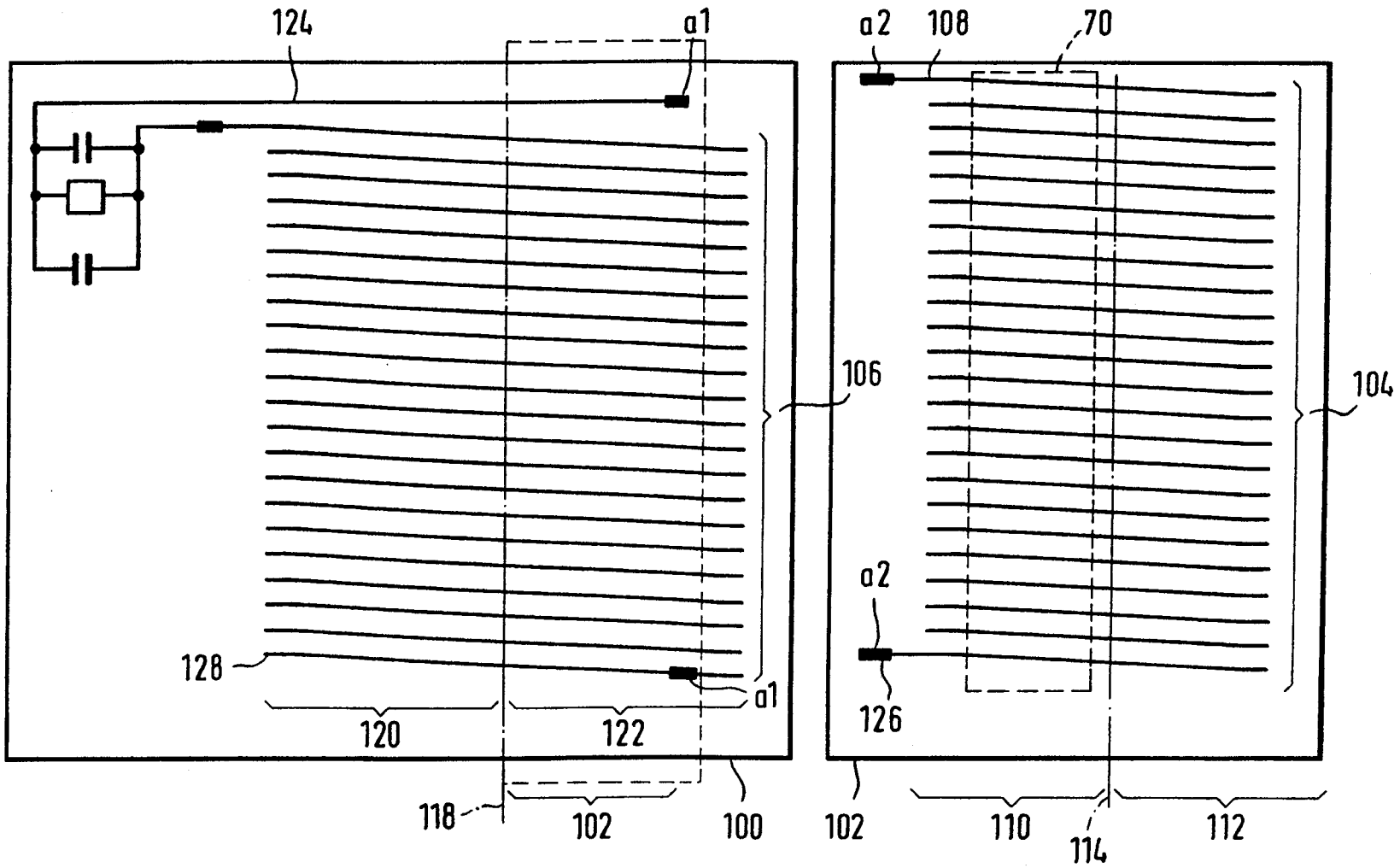
FIG. 10 shows a second embodiment according to the invention, of yet another method of laying out the films to produce a twin-layer winding.

As yet another embodiment of the invention, a second method of forming a multi-layer winding is shown in FIG. 10. Two films 100 and 102 are shown bearing printed wiring sections 106 and 104 respectively. It will be noted, that the first and the last printed wires extend beyond the rest of the printed wiring section 104, to form extensions 108 and 126. The film 102 will be the inside film and the film 100 will be the outside film. The surface turned away from the reader of both films 100 and 102 bears printed wiring 106 and 104. In order to produce a twin-layer antenna, the magnetic core 70 is positioned underneath section 110 of the film 104 as is illustrated in FIG. 10 by the dashed lines in film 102. The film section 112 is then folded back into the page along the center line 114 through 180°, sliding underneath the magnetic core 70 such that the magnetic core 70 is lying between the film sections 110 and 112. The mutually opposite start and end points of the printed wiring 102 are electrically connected with each other using one of the above described methods. After this, the folded film 102 is layed upon the printed wire section 122 of film 100, such that printed wiring section 112 of film 102 is lying directly over printed wiring section 122 of film 100. Therefore, the center lines 114 and 118 coincide and the folded film 102 connection points a2 are lined up with the start points a1 of printed wiring section 122. Therefore, when film 100 is folded along the center line 118 towards the reader, through 180°, the folded film 102 also folds through 180° such that the mutually opposite start and end points of the printed wiring 106 are electrically connected with each other and extension 108 will simultaneously be connected to the start point 124 of printed film 106. In this way, printed wiring 104 and printed wiring 106 are connected to form one continuous coil. As can be seen from FIG. 10, the necessary number of coil layers can be easily facilitated.

Figure 6:
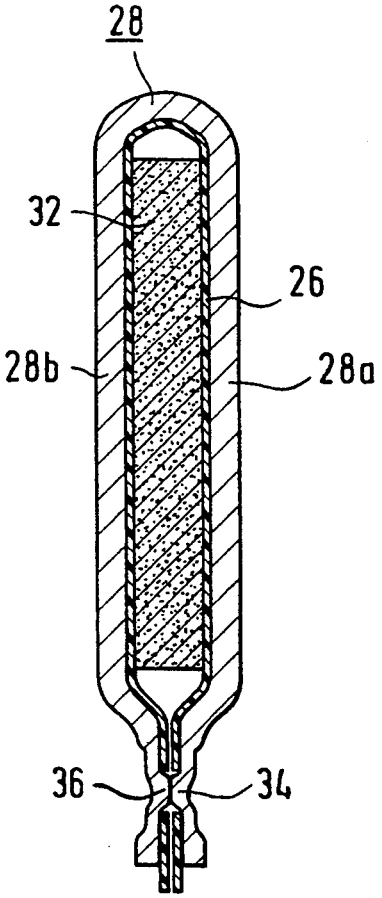
FIG. 6 is a cross-section on a larger scale taken on the line VI—VI of FIG. 5.
Figure 11:
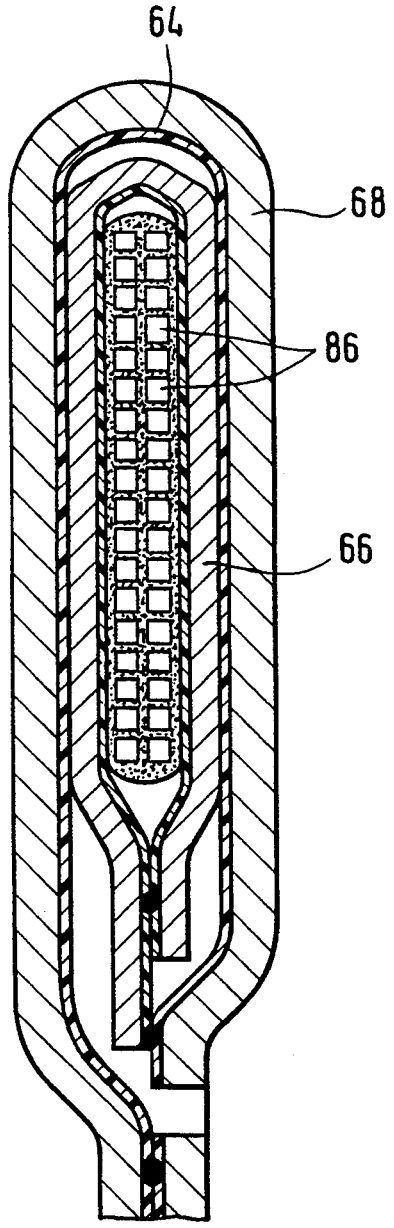
FIG. 11 is a cross-sectional view of an HF antenna with a two-layered winding similar to that shown in FIG. 6.

FIG. 11 shows an HF antenna with a twin-layer winding in a cross-sectional view similar to that of FIGS. 3 and 6. As shown in FIG. 11, it would be readily possible to produce a triple-layer winding by the addition of a further layer. The film 64 would then have to have two further film sections, which would be provided with corresponding printed wiring and connections.

In addition, FIG. 11 indicates the particular feature that the magnetic core is not, as in the previous embodiments, made up of thin layers of amorphous metallic glass, but rather of individual plates 86 of ferromagnetic material, which are embedded in a base or carrier material so that the magnetic core still has the desired flexibility like a flexible chain.

Figure 12:
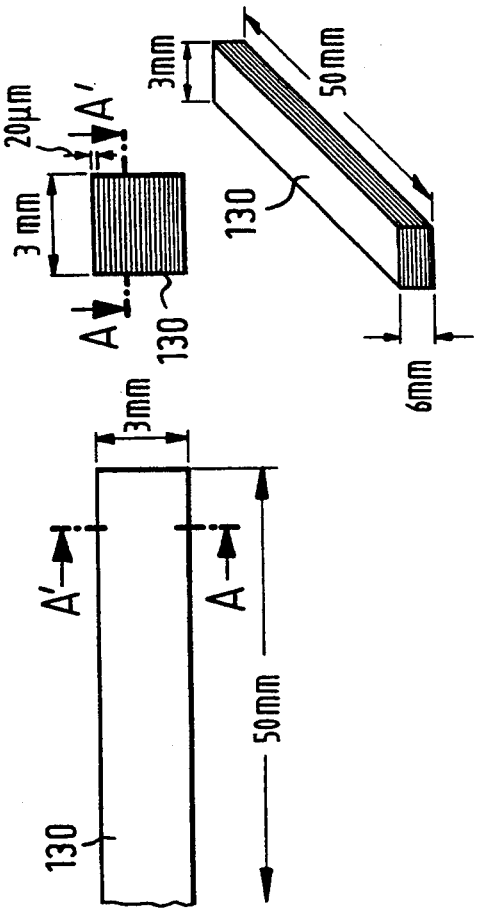
FIG. 12 shows three views of one method of forming an amorphous alloy flexible core.

FIG. 12 shows an alternative method of forming the magnetic core still using individual plates of insulated ferromagnetic material or amorphous alloy 130. The insulation could be, for example, an oxide layer coating the strips. A stack of insulated strips of amorphous alloy 130 is formed wherein the strips are, for example, 50 mm long, 20 μm thick and 12 mm wide, such that the stack is still 50 mm long and 12 mm wide but greater than 20 μm thick. Unfortunately, this resultant core displays a rather low Q performance. If, however, the width of the strip 130 is cut from 12 mm to 2 or 3 mm, thereby yielding a stack 50 mm long, 3 mm wide and for example 0.6 mm thick, the Q performance of the core is enhanced greatly. Furthermore, the more narrow the strips, the higher the Q performance.

Figure 13:
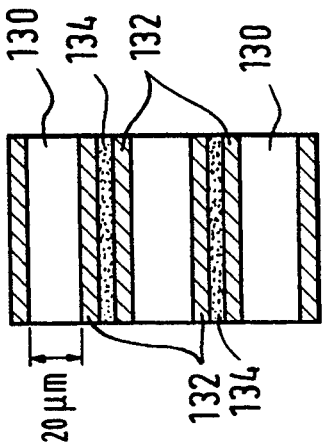
FIG. 13 is a blown up cross-sectional view of several amorphous alloy strips of FIG. 12, stacked, depicting the oxide layer surrounding the alloy strip and the adhesive layer which can be used to hold the strips together.

There are many different ways to connect these stacks or blocks of amorphous alloy such that they are attached to one another while still maintaining flexibility of movement. One method shown in FIG. 13, is to adhere the layer of strips together by using a tacky adhesive layer 134 between the strips. The adhesive would fill in the surface roughness that may exist on the surface of the strips. A very thin layer of adhesive can be achieved by spraying, rolling or dipping the strips into a bath. Adhesive is also available in a tape version. Using any of the above-mentioned methods, the adhesive can be applied judiciously such that flexibility of movement is not restricted. After the strips with the adhesive have been stacked, the adhesive can be cured in many ways including heat, pressure, ultra-violet source, and light source. The amount of time required for curing would depend upon the type of adhesive.

Figure 14D:
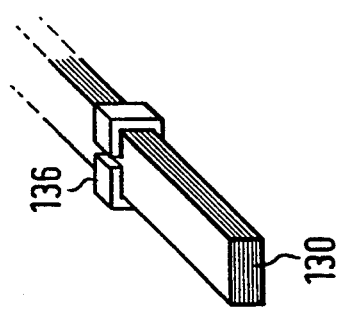
FIGS. 14*b*–14*d* are two dimensional views of FIG. 14*a* showing different configurations of the foil 136.
Figure 14C:
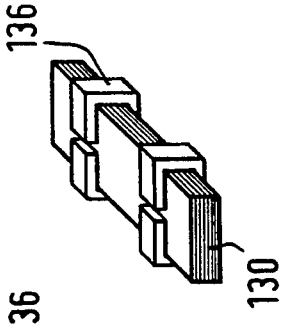
Figure 14B:
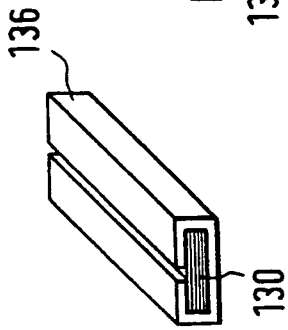
Figure 14A:
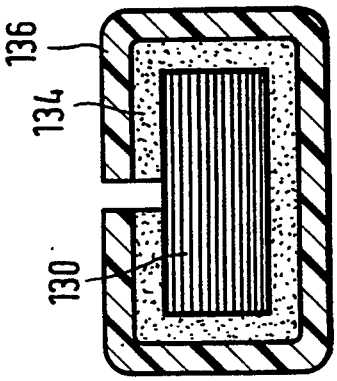
FIG. 14*a* is cross-sectional view of a second method of holding the amorphous alloy strips together.

A second method of forming a stacked amorphous core is to stack, for example, 30 layers of 50 mm long, 3 mm wide and 20 μm thick strips of amorphous alloy 130 on top of one another, and then wrap an adhesive coated piece of foil 136 around the stack such that the adhesive is contacting the top and bottom strip as well as the edges of all the strips as shown in FIG. 14*a*. The foil 136 can be wrapped around the block of strips 130, either along the full length as shown in FIG. 14*b*, in two strips on either end like a clamp as shown in FIG. 14*c*, or one strip in the middle to facilitate flexibility on the ends as shown in FIG. 14*d*.

Figure 15:
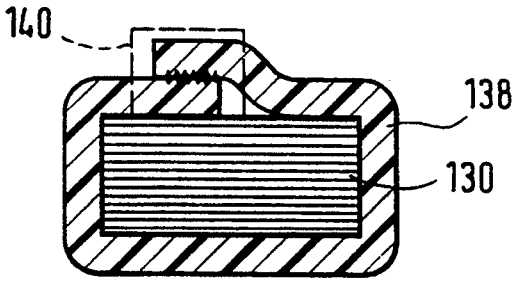
FIG. 15 is a cross-sectional view of yet another method of holding the amorphous strips together.

A third method of forming a stacked amorphous core is to again stack 30 layers of 50 mm long, 3 mm wide and 20 μm thick strips of amorphous alloy on top of one another, and then wrap a non-coated foil 138 around the stack such that one end of the foil covers the other end as shown in FIG. 15. Next, laminate the region of overlap of the foil 140 by applying heat or pressure and/or use an adhesive to adhere the overlapping foil to itself. Again, the foil 138 can be wrapped around the blocks or single strips either along the full length, in two strips on either end like a clamp, or one strip in the middle to facilitate flexibility on the ends.

Figure 16A:
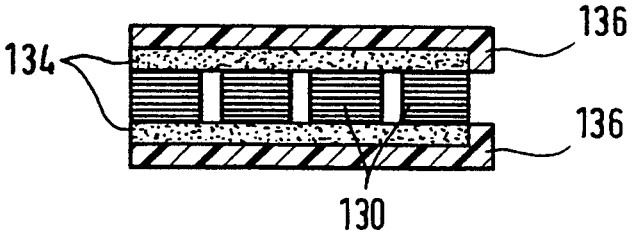
FIG. 16*a* is a cross-sectional view of the flexible core of an antenna formed of blocks of amorphous alloy.
Figure 16B:
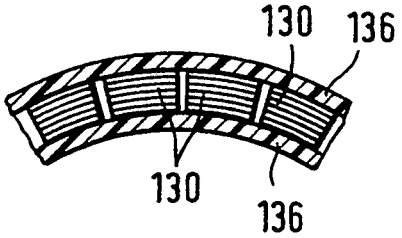
FIG. 16*b* is the same core of FIG. 16*a* bent.
Figure 17:
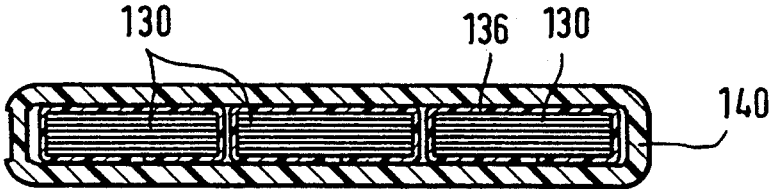
FIG. 17 is a cross-sectional view of a possible resultant flexible antenna configuration.

A method for forming an antenna from several blocks of strips or several single strips is shown in FIG. 16. The blocks or single strips of amorphous alloy 130 are placed beside one another, leaving space in between for isolation and orientation purposes, on an adhesive coated foil 136 in FIG. 16*a*. Once the blocks or single strips 130 are adhered to the base foil 136, the antenna core can be bent to any desired radius or shape as shown in FIG. 16*b*. A second adhesive foil 136 can then be adhered to the topside of the blocks or single strips 130, maintaining the antenna core in the desired shape. Alternatively, the adhesive tape may be one piece that just gets wrapped around the blocks or single strips, either along the full length of the blocks or single strips, in two strips on either end like a clamp, or one strip in the middle to facilitate flexibility on the ends. In addition, with double sided-adhesive tape, one layer of blocks or single strips can be mounted on both sides of the tape.

Figure 18:
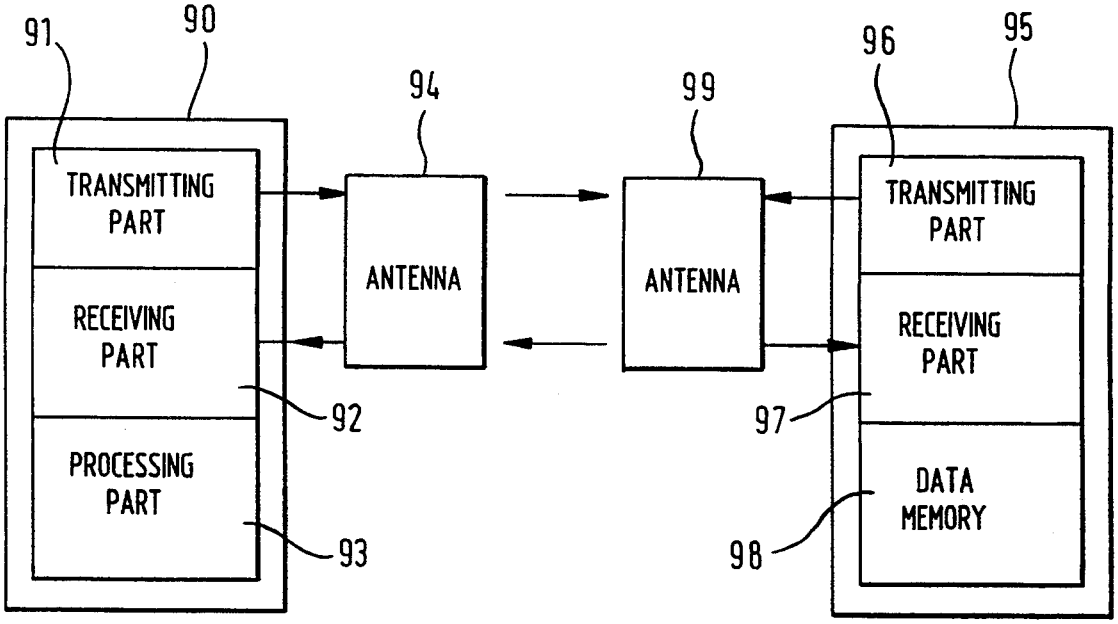
FIG. 18 is a diagrammatic representation of a transponder system in which the HF antenna in accordance with the invention may be used.

The above described HF antenna may be advantageously employed in a transponder system as in the illustrated working embodiment of the diagrammatic FIG. 18. This transponder system comprises an interrogating device 90 with a transmitting part 91, a receiving part 92 and a processing part 93. The transmitting part 91 and the receiving part 92 are coupled with an antenna 94, which is able to transmit and receive HF signals. Furthermore, the transponder system comprises an answering device 95 with a transmitting part 96, a receiving part 97 and a data memory 98. The transmitting part 96 and the receiving part 97 are coupled with an antenna 99 which is able to transmit and receive the HF signals.

The answering device 95 may be arranged on some object which is denoted by an identification number and this identification number is stored in the data memory 98. The content of the data memory 98 may be transmitted to the interrogating device 90 and it may be process by the processing part 93. It is in this manner that it is possible to identify the object which bears the answering device 95. The complete answering device may be housed in a synthetic resin card or board, which for instance is in the form of a credit card. In the case of this application, it is necessary for the antenna 99 together with its antenna winding to be very thin and furthermore so flexible that when the synthetic resin card is bent, in which it is accommodated, it is not damaged.

In the illustrated case of application the following steps take place during an identifying operation.

The interrogating device 90 transmits continuously or only after actuating a push button, not shown, an HF interrogating pulse (which is produced in the transmitting part 91) via the antenna 94. The frequency of the HF pulse will for instance be at approximately 130 kHz. The emitted HF interrogating pulse is received by the antenna 99 of the answering device 95. The HF interrogating pulse received by the antenna 99 is rectified in the receiving part 97 and used to charge a capacitor functioning as an energy storing means and from which the power supply energy for the answering device 95 is taken after the end of the HF interrogating pulse. When the voltage present in the energy storing capacitor has a sufficient value after the end of the HF interrogating pulse, in the answering device 95 the transmission of a HF signal via the antenna 99 is caused to take place and from the transmitting part 96, such signal containing the content of the data memory 26 in an encoded form. This encoding action may for instance be by modulation of the HF signal. The HF signal, which is transmitted from the antenna 99, is received by the antenna 94 of the interrogating device 90 and it is fed from the receiving part 91 thereof to the processing part 93, in which the HF signal is then decoded. It is in this manner that it is possible to use the interrogating device 90 to read the content of the data memory 98 so that with reference to the decoded information it is possible to positively identify the object, on which the answering device 95 is arranged or to identify a person carrying the answering device 95.

The detailed design of the interrogating device 90 and of the answering device 95 is only of subordinate importance for the HF antenna described herein and may be as is described in the European patent publication 0 301 127 A (or the equivalent U.S. Pat. No. 5,053,774).

One skilled in the art will readily see that the HF antenna described herein is particularly suitable for application in an answering device in the form of synthetic resin card owing to its thin and flexible structure.

An account will now be provided of some particular working embodiments of the described HF antenna with details of the respectively utilized material.

EXAMPLE 1

A piece of film polyester with a thickness of 12 to 50 microns is employed, on which the printed wiring of copper is applied with a thickness of 35 microns. Adjacent to the start and end points of the printed wiring windows are formed as shown in FIG. 1, over which the printed wiring is spanned. The width of the printed wiring is equal to 100 microns and furthermore, the distance from one piece of printed wiring to the next is equal to 100 microns. For the magnetic core, thin layers of amorphous metallic glass are used as, for instance, as described in A.I.P. Cosf. Vol. 24, 1974, pages 745 and 746, "Ferromagnetic Behavior of Metallic Glasses" by Sherwood, R. C., et al. A material which may be utilized for the layers of the magnetic core is as described in the paper "Weichmagnetische Kristalline und Amorphe Metale" by Boll, R. and Hilzinger, H. R., in "Elektronik", 1987. The connection of the start and end points, which are exposed in the window zones, is performed by welding or soldering. In the finished antenna the printed wiring is on the surface of the polyester film which is turned away from the magnetic core.

EXAMPLE 2

The same materials are employed for the film, the printed wiring and the magnetic core as in Example 1. At the start and end points of the printed wiring, no windows are formed in the film however. The film with the printed wiring is so wrapped around the magnetic core that the printed wiring is on the side of the film facing away form the magnetic core. The production of the electrically conducting connections between the start and end points of the printed wiring is performed by a welding process in which two dies are employed on the two sides to apply pressure and heat in the connection zone so that the polyester film present in the connection zone is heated and displaced by pressure.

EXAMPLE 3

The same materials are utilized for the film, the printed wiring and the magnetic core as in the working embodiment 1. The printed wiring is however coated with an adhesive and the film is so wrapped around the magnetic core that the film is on the outside and the adhesive comes into contact with the magnetic core and also holds the connection zones together. Adjacent to the start and end points of the printed wiring section projections are formed, which are joined together by pressure until an electrical contact is formed. The adhesive maintains the electrical connection.

EXAMPLE 4

A 12 micron thick polyamide film is used, on which the copper printed wiring is applied with a thickness of 18 or 35 microns. The copper material is tinned with a thickness of 4 to 5 microns and furthermore the breadth and the distance apart between the sections of printed wiring amounts to 100 microns. For the magnetic core the same material is utilized as in Example 1. On the printed wiring side there is, as in Example 3, an adhesive layer and the film with the printed wiring and the adhesive layer is so wrapped around the magnetic core that the adhesive becomes united with the magnetic core. Adjacent to the start and end points of the printed wiring, heat is transmitted to the printed wiring through the polyamide film so that the tinned printed wiring is soldered together at a joint.

In all the examples described, it is possible for the magnetic core to be made up of individual plates of ferromagnetic material and not of individual layers of amorphous metallic glass, such individual plates being connected with the aid of a carrier or base material to take the form of a chain. In addition, any flexible core will work with the described embodiments above.

It is claimed:

1. A method of producing an antenna comprising the steps of:

forming a plurality of printed wiring on a first and second film, each individual wire of said plurality having a start and end point;

defining windows in said first and second said films to expose the start and end points of said individual wires;

placing a magnetic core between said first and second film such that the exposed start points of said first film are in register with the exposed end points of said second film and said exposed start points of said second film are in register with said end points of said first film; and electrically connecting those start and end points which are in register with each other.

2. The method of claim 1 wherein said step of electrically connecting comprises the steps of welding said in register start and end point.

3. The method of claim 1 wherein said step of electrically connecting comprises the steps of tinning said exposed start and end points, and then soldering said in register start and end point.

4. The method of claim 1 wherein said step of placing a magnetic core between said first and second film comprises the step of placing a magnetic core composed of thin layers of amorphous metallic glue.

5. The method of claim 1 wherein said placing step comprises the step of placing a magnetic core composed of aligned and assembled ferrite plates held together by a flexible film.

6. A method of producing an antenna comprising the steps of:

forming a plurality of printed wires as a film, each individual wire of said plurality having a start and end point;

defining windows in said film to expose the start and end points of each individual wires;

folding said film with said printed wires about a line through approximately 180° such that individual ones of the exposed end points in register with individual ones of the exposed start points;

placing a magnetic core within the fold of said folded film; and electrically connecting those start and end points which are in register with each other.

7. The method of claim 6 wherein said step of electrically connecting comprises the steps of welding said in register start and end point.

8. The method of claim 6 wherein said step of electrically connecting comprises the steps of tinning said exposed start and end points, and then soldering said in register start and end point.

9. A method of producing an antenna comprising the steps of:

forming a plurality of printed wires on a first and second film, each of said plurality having a start and end point;

placing a magnetic core between said first and second film such that the start points of said first film are in register with said end points of said second film and said start points of said second film are in register with said end points of said first film;

squeezing said first and second film together where said start and end points are in register; and applying heat during said squeezing step to melt and displace said film so that said in register start and end points are in electrical contact with each other.

* * * * *